US007512377B2

(12) United States Patent
Choi et al.

(10) Patent No.: US 7,512,377 B2
(45) Date of Patent: Mar. 31, 2009

(54) SYSTEM AND METHOD FOR EXTENDING SPEED CAPABILITY OF SHEET REGISTRATION IN A HIGH SPEED PRINTER

(75) Inventors: Injae Choi, Webster, NY (US); Michael J. Linder, Walworth, NY (US); Lloyd A. Williams, Mahopac, NY (US); Joannes N. M. deJong, Hopewell Junction, NY (US)

(73) Assignee: Xerox Corporation, Stamford, CT (US)

( * ) Notice: Subject to any disclaimer, the term of this patent is extended or adjusted under 35 U.S.C. 154(b) by 463 days.

(21) Appl. No.: 11/110,078

(22) Filed: Apr. 20, 2005

(65) Prior Publication Data

US 2006/0239733 A1 Oct. 26, 2006

(51) Int. Cl.
*G03G 15/00* (2006.01)

(52) U.S. Cl. ..... 399/396; 399/394; 399/395; 271/270

(58) Field of Classification Search ..... 399/396, 399/395, 394; 271/270; 101/481
See application file for complete search history.

(56) References Cited

U.S. PATENT DOCUMENTS

| | | | | |
|---|---|---|---|---|
| 4,411,418 | A | 10/1983 | Poehlein | |
| 4,438,917 | A | 3/1984 | Janssen et al. | |
| 4,451,027 | A * | 5/1984 | Alper | 271/10.02 |
| 4,511,242 | A | 4/1985 | Ashbee et al. | |
| 4,519,700 | A | 5/1985 | Barker et al. | |
| 4,877,234 | A | 10/1989 | Mandel | |
| 4,971,304 | A | 11/1990 | Lofthus | |
| 5,078,384 | A | 1/1992 | Moore | |
| 5,094,442 | A | 3/1992 | Kamprath et al. | |
| 5,156,391 | A | 10/1992 | Roller | |
| 5,169,140 | A | 12/1992 | Wenthe, Jr. | |
| 5,219,159 | A | 6/1993 | Malachowski et al. | |
| 5,273,274 | A | 12/1993 | Thomson et al. | |
| 5,278,624 | A | 1/1994 | Kamprath et al. | |
| 5,337,135 | A * | 8/1994 | Malachowski et al. | 399/401 |
| 5,555,084 | A | 9/1996 | Vetromile et al. | |
| 5,678,159 | A | 10/1997 | Williams et al. | |
| 5,697,608 | A | 12/1997 | Castelli et al. | |
| 5,697,609 | A | 12/1997 | Williams et al. | |
| 5,715,514 | A | 2/1998 | Williams et al. | |
| 5,794,176 | A | 8/1998 | Milillo | |
| 5,826,157 | A * | 10/1998 | Wierszewski | 399/396 |
| 6,059,284 | A | 5/2000 | Wolf et al. | |
| 6,137,989 | A | 10/2000 | Quesnel | |
| 6,168,153 | B1 | 1/2001 | Richards et al. | |
| 6,322,069 | B1 * | 11/2001 | Krucinski et al. | 271/265.02 |
| 6,374,075 | B1 * | 4/2002 | Benedict et al. | 399/395 |
| 6,533,268 | B2 | 3/2003 | Williams et al. | |
| 6,608,991 | B2 * | 8/2003 | Takada | 399/394 |
| 2003/0146567 | A1 | 8/2003 | Williams et al. | |

* cited by examiner

*Primary Examiner*—Leslie J Evanisko
*Assistant Examiner*—Matthew G Marini
(74) *Attorney, Agent, or Firm*—Carter, DeLuca, Farrell & Schmidt, LLP

(57) ABSTRACT

A system and method for registering a sheet transported along a sheet path of a printing system, including receiving a sheet at a first location, transporting the sheet along the sheet path from the first location in a downstream direction at a first speed. The speed at which the sheet is transported is decreased from the first speed to a second speed. The transported sheet is received at a second location downstream from the first location and registered at the second location, including correcting at least one of lateral position of the sheet, skew of the sheet, and timing error in a downstream direction.

20 Claims, 3 Drawing Sheets

SYSTEM AND METHOD FOR EXTENDING SPEED CAPABILITY OF SHEET REGISTRATION IN A HIGH SPEED PRINTER

BACKGROUND

Patents related to the present disclosure include U.S. Pat. Nos. 4,411,418; 4,438,917; 4,511,242; 4,519,700; 4,877,234; 4,971,304; 5,078,384; 5,094,442; 5,156,391; 5,169,140; 5,219,159; 5,273,274; 5,278,624; 5,555,084; 5,678,159; 5,697,608; 5,697,609; 5,715,514; 5,794,176; 6,059,284; 6,137,989; 6,168,153 B1; 6,374,075; 6,533,268 B2 and U.S. Patent Application Publication No. 20030146567, published Aug. 7, 2003, all of which are incorporated herein by reference in their entirety.

This disclosure relates generally to an electrographic printing system and method, and more particularly to a system and method for extending speed capability of sheet registration in an image reproduction system.

High quality document production in a printing system requires precise placement of a copy sheet or other image receiving substrates to the photoreceptor for image transfer. Such precise placement includes accurate registration for positioning the copy sheet in the printing system. A printing system may be configured to operate in a first configuration for transferring images and printing the transferred images at a standard speed, where copy sheets are transported at an input speed to a registration system for registration of the copy sheets. After registration the copy sheets are transported at a process speed, where the process speed is slower relative to the input speed for transferring the image to the copy sheet.

In a printer system in which the operating speed is increased for increasing the rate at which sheets are processed for transferring images to the copy sheets, the registration time may be reduced, thus limiting the capability of the registration process. Furthermore, the copy sheet may exert an increased drive force within the registration system, which may damage the copy sheet, such as by causing marks on the copy sheet. Possible solutions may include varying registration parameters, e.g., the distance between respective transport systems for gripping the copy sheet and moving it along within the registration system, or adjusting registration specifications of the registration system. However, these adjustments may limit the versatility of the printing system, such as by reducing the range of media sizes which may be handled by the registration system and further do not address the issue of decreased registration time.

SUMMARY

Accordingly, it is an aspect of the present disclosure to provide a system and method for reducing the copy sheet speed from the input speed to the process speed prior to beginning registration. Thus an increased amount of time is allowed for performing registration for achieving correction over a range of errors without violating known constraints, even when operating the printing system at an extended speed capability which is higher than standard speed for which the range of error corrections and constraints were originally established.

In accordance with one aspect of the present disclosure there is provided an electrographic printing system including a movable image carrying member for carrying a developed liquid toner image; a transfer station for transferring the developed liquid toner image to a substrate, and a registration system for registering a sheet transported along a sheet path. The registration system includes a first transport station disposed along the sheet path for receiving the sheet at a first speed and for transporting the sheet along the sheet path at a second speed which is slower than the first speed, and a first apparatus in operative communication with the first transport station for decreasing the first speed of the sheet to the second speed. The registration system further includes a second transport station disposed downstream of the first transport station and upstream of the transfer station for receiving the sheet at a speed which is one of equal to and slower than the second speed, and a second apparatus in operative communication with the second transport station for exerting at least one force on the sheet for registering the sheet, the registering including correcting at least one of lateral position of the sheet, skew of the sheet, and timing error in the downstream direction.

Pursuant to another aspect of the present disclosure, there is provided a method for registering a sheet transported along a sheet path of a printing system, including receiving a sheet at a first location, transporting the sheet from the first location in a downstream direction at a first speed. The speed at which the sheet is transported is decreased from the first speed to a second speed. The transported sheet is received at a second location downstream from the first location and registered at the second location, including correcting at least one of lateral position of the sheet, skew of the sheet, and timing error in a downstream direction.

Pursuant to yet another aspect of the present disclosure, there is provided a registration system for registering a sheet transported along a sheet path of a printing system. The registration system includes a first transport station disposed along the sheet path for receiving the sheet at a first speed and for transporting the sheet along the path at a second speed which is slower than the first speed, and a first apparatus in operative communication with the first transport station for decreasing the first speed of the sheet to the second speed. The registration further includes a second transport station disposed downstream of the first transport station for receiving the sheet at a speed which is one of equal to and slower than the second speed, and a second apparatus in operative communication with the second transport station for exerting at least one force on the sheet for registering the sheet, the registering including correcting at least one of lateral position of the sheet, skew of the sheet, and timing error in the downstream direction.

BRIEF DESCRIPTION OF THE DRAWINGS

Various embodiments of the present disclosure will be described herein below with reference to the figures wherein.

DETAILED DESCRIPTION OF THE PREFERRED EMBODIMENTS

Figure 1:
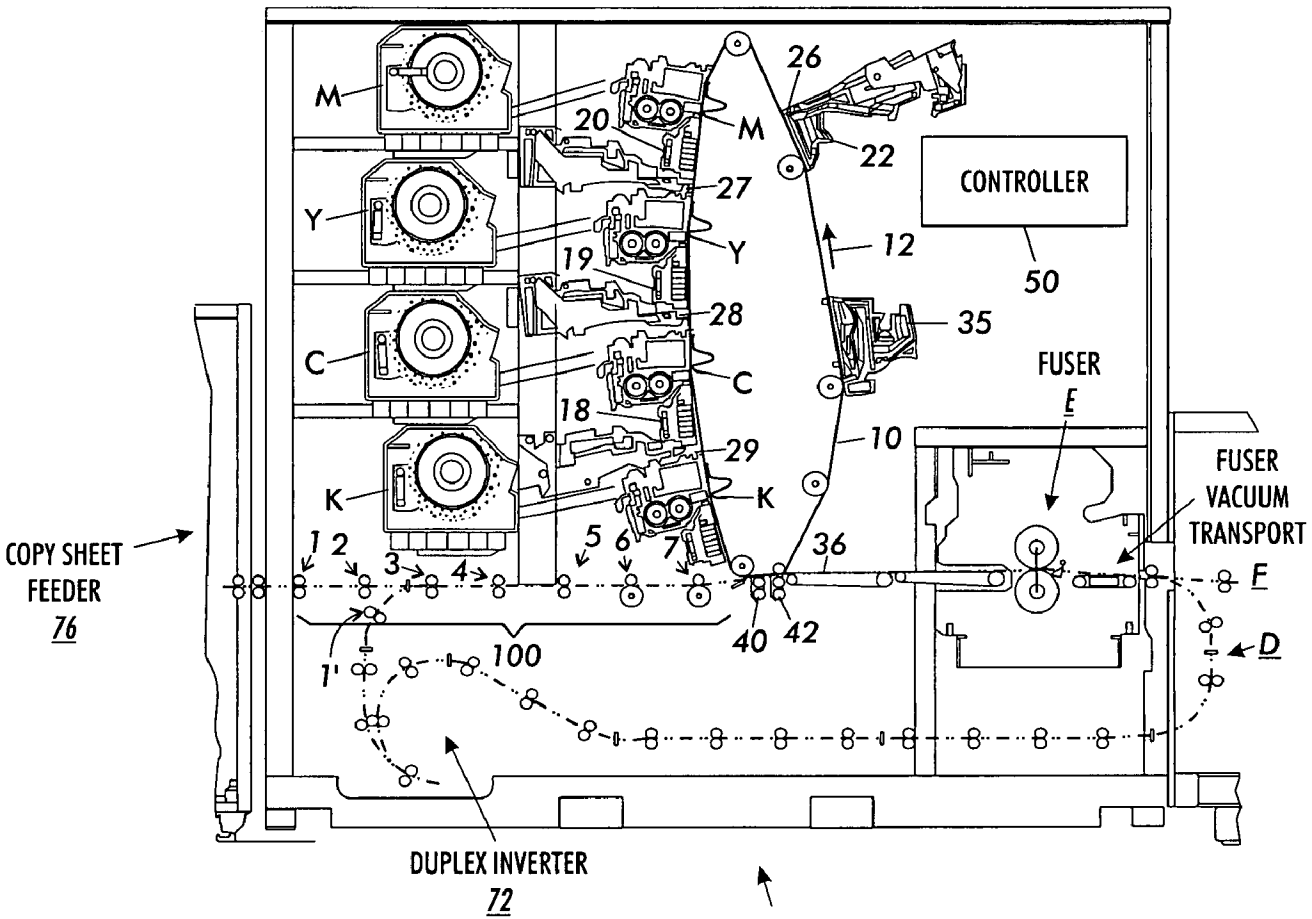
FIG. 1 is a schematic elevational view depicting an illustrative printing system incorporating a sheet registration system of the present disclosure.

For a general understanding of the features of the present disclosure, reference is made to the drawings. In the drawings, like reference numerals have been used throughout to identify identical elements.

FIG. 1 shows an electrographic printing system 1000 including copy sheet registration system 100 according to an embodiment of the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, et., which performs a print outputting function for any purpose. Photoreceptor belt 10 advances in the direction of arrow 12 through the various processing stations around the path of belt 10. Charger 22 charges an area of belt 10 to a relatively high, substantially uniform potential. Next, the charged area of belt 10 passes laser 26 to expose selected areas of belt 10 to a pattern of light, to discharge selected areas to produce an electrostatic latent image. Next, the illuminated area of the belt passes developer unit M, which deposits magenta toner on charged areas of the belt.

Subsequently, charger 20 charges the area of belt 10 to a relatively high, substantially uniform potential. Next, the charged area of belt 10 passes laser 27 to expose selected areas of belt 10 to a pattern of light, to discharge selected areas to produce an electrostatic latent image. Next, the illuminated area of the belt passes developer unit Y, which deposits yellow toner on charged areas of the belt.

Subsequently, charger 19 charges the area of belt 10 to a relatively high, substantially uniform potential. Next, the charged area of belt 10 passes laser 28 to expose selected areas of belt 10 to a pattern of light, to discharge selected areas to produce an electrostatic latent image. Next, the illuminated area of the belt passes developer unit C, which deposits cyan toner on charged areas of the belt.

Subsequently, charger 18 charges the area of belt 10 to a relatively high, substantially uniform potential. Next, the charged area of belt 10 passes laser 29 to expose selected areas of belt 10 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 10. In synchronism with the movement of the image on belt 10, registration system 100 brings a copy sheet into contact with the image on belt 10. Registration system 100 receives the sheet via high capacity sheet feeder 76 or via duplex sheet inverter 72. The registration system includes a plurality of transport systems 1, 1', 2, 3, 4, 5, 6 and 7 for transporting a copy sheet to a transfer point where the image is transferred to the sheet. The transport systems 1, 1', 2, 3, 4, 5, 6 and 7 are controlled for timing arrival of the sheet and/or adjusting positioning of the sheet in order that the sheet be aligned and positioned for accurate transfer of the image and outputting the sheet at a process speed appropriate for image transfer, where the process speed is the speed at which the sheet is transported during image transfer. Registration system 100 is subsequently described in more detail below.

A corotron 40 charges the sheet, from sheet registration system 100, to tack the sheet to belt 10 and to move the toner from belt 10 to the sheet. Subsequently, detack corotron 42 charges the sheet to an opposite polarity to detack the sheet from belt 10. Prefuser transport 36 moves the sheet to fuser E, which permanently affixes the toner to the sheet with heat and pressure. The sheet then advances to output section F, or to duplex loop D.

Cleaner 35 removes toner that may remain on the image area of belt 10. In order to complete duplex copying, duplex loop D feeds sheets back to registration system 100 via various rollers for transfer of a toner powder image to the opposed sides of the sheets. Duplex inverter 72, in duplex loop D, inverts the sheet such that what was the top face of the sheet, on the previous pass through system 100, will be the bottom face on the sheet, on the next pass through system 100. Duplex inverter 72 inverts the sheet such that what was the leading edge of the sheet, on the previous pass through system 100, will be the trailing on the sheet, on the next pass through system 100.

The printing system 1000 is configurable in a first configuration for operating, including transferring images and printing the transferred images, at a standard speed. A typical standard speed is about 100 pages per minute (PPM), where the input speed at which the sheet is received by the registration system 100 for the sheet is typically about 1.025 m/sec, and the transfer procedure is performed at a process speed typically of about 0.468 m/sec. The printing system 1000 is further configurable in a second configuration, such as by installation of a speedup product on the printing system 1000, for enabling the printing system to transfer images at an increased speed, such as up to about 150 PPM. In the second configuration the input speed is increased, proportional to the increased speed for transferring images, such as to about 1.5375 m/sec, the time interval between processing sheets is reduced, and the process speed is increased to about 0.702 m/sec. Installation of the speedup product includes upgrading motors, such as motors for moving belt 10 and for moving elements which transport the sheet, where the upgraded motors are capable of operating at higher speeds. Upgrading a motor may include replacing a previous motor used for operating at the standard speed. Additionally, moving parts may be upgraded for accommodating the increased speeds. Furthermore, control of the motors and/or other moving parts is adjusted for operating the motors at the higher speeds.

In order for the registration system 100 to be operable with installation of the speed-up product additional modifications are made to the registration system 100 and the controller 50 in accordance with the present disclosure. The modifications are described in greater detail below.

In the first configuration, traditionally, the sheet speed is reduced from the input speed to the process speed as the sheet is registered in the registration system. However, in the second configuration it has been demonstrated that it is beneficial to reduce the sheet speed from the increased input speed prior to beginning registration. Advantages reaped by decreasing the transport speed of the sheet prior to registration include maintaining a sufficiently long registration time for registering the sheet in accordance with predetermined constraints, and limiting force exerted by the sheet within the registration sheet which could potentially damage the sheet.

Figure 2:
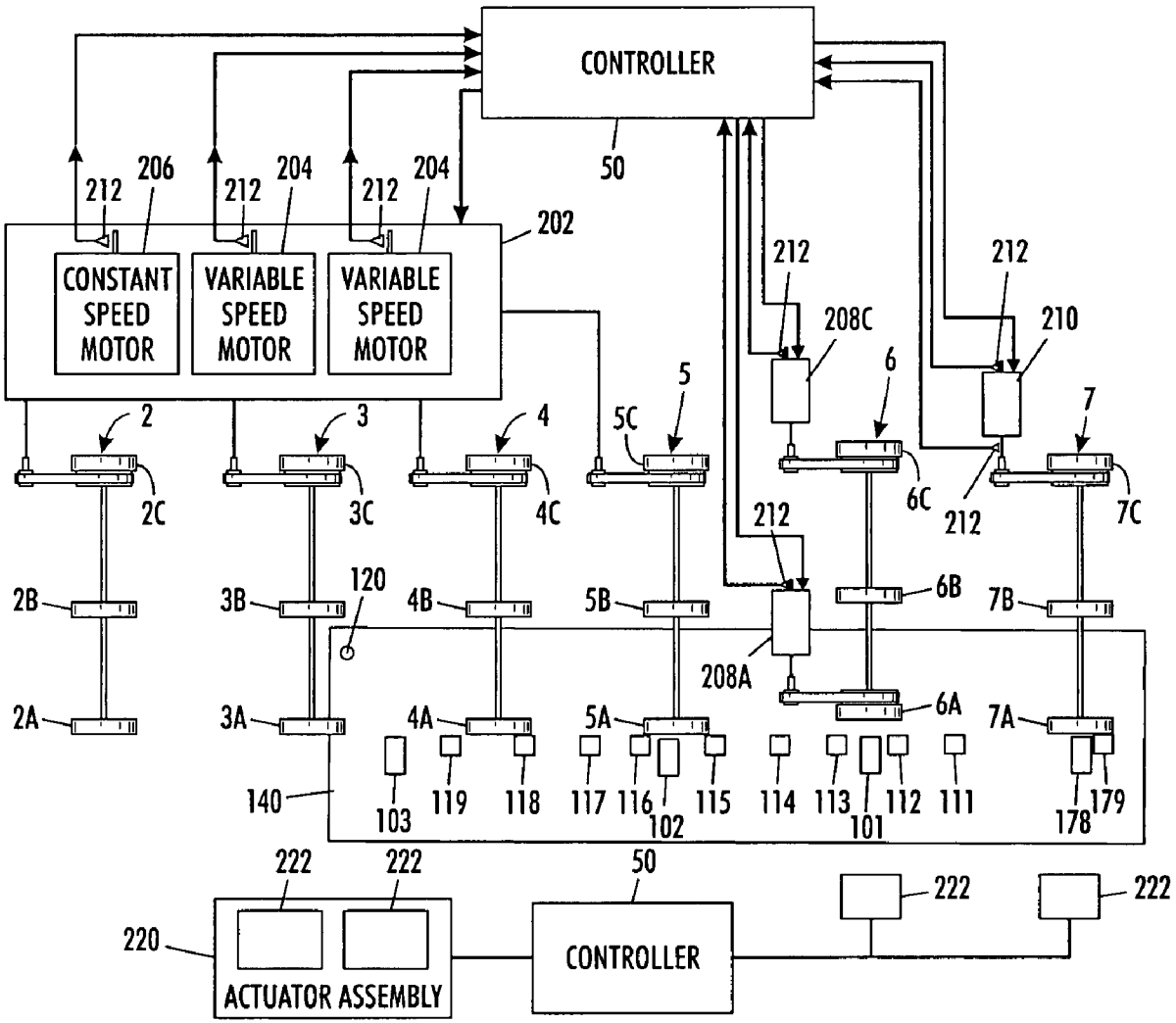
FIG. 2 is a plan view of the sheet registration system shown in FIG. 1.

FIG. 2 is a plan view showing registration system 100 in more detail as configured for use in the second configuration of the printing system 1000. It is contemplated that the registration system 100 of the present disclosure may be employed and provide advantages in a wide variety of printing systems and is not specifically limited in its application to the particular embodiment of the printing system 1000 depicted herein. For example, the registration system 100 may be employed in a high speed black and white printer, a highlight color printer, a multi-pass color printer etc. Additionally, the registration system 100 may be employed and provide advantages in printing systems which operate at standard speeds.

The respective transport stations 2-7 are shown to each include three nips, each respective nip including a rubber drive roller and corresponding idler roller which may be engaged for engaging a sheet and transporting the sheet through the nip, or disengaged for releasing the sheet. As shown in FIG. 2, transport station 2 includes nips 2A, 2B and 2C. Subsequent, downstream, transport station 3 includes nips 3A, 3B, and 3C. Subsequent transport station 4 includes nips 4A, 4B, and 4C. Subsequent transport station 5 includes nips 5A, 5B, and 5C. Subsequent transport station 6 includes nips 6A, 6B, and 6C. Subsequent transport station 7 includes nips 7A, 7B, and 7C. Respective nips of transport stations 1-7 may include a motor pulley, belt, and registration shaft which is driven by a corresponding motor (as described further below) for driving the drive roller of the respective nips.

Engagement and disengagement of the respective nips is actuated by at least one actuator, such as a cam and stepper motor mechanism, where the at least one actuator is controlled by the controller 50. Typically, when a respective transport station transports a sheet, two nips of the transport station engage the sheet and the other nip is disengaged. Selection of which nip of a transport station is disengaged is in accordance with the paper size. A respective transport station disengages the copy sheet once an adjacent downstream transport station engages the copy sheet. Once the trailing edge of the sheet has been transported past the transport station, the nips of the transport station are typically reengaged to achieve the expected starting speed at which a subsequent sheet is expected to be received for smoothly receiving the sheet. The at least one actuator is discussed further below.

The sheet may be provided to the registration system from the sheet feeder 76, which may include a master feeder and/or auxiliary feeders, where the transport sheet is sequentially transported by transport stations 1, 2, 3, 4, 5, 6, and 7. Furthermore, the sheet may be provided to the registration system 100 via the duplex loop D, where the transport sheet is sequentially transported by transport stations 1', 3, 4, 5, 6, 7. Transport stations 1, 1', 2, 3, 4 and 5 transport the sheet to the registration transport station 6, where the nips of transport station 6 operate in accordance with respective velocity profiles for correcting skew, lateral position and timing errors. Transport station 7 is a pre-transfer transport station for transporting the sheet to a transfer area where the image transfer takes place, e.g., at corotron 40. The nips of transport station 7 may be operated in accordance with a velocity profile for fine tuning detected skew, lateral position and/or timing errors which may still exist as the sheet exits the registration transport station 6, and may also provide correction to the speed of belt 10.

In a printing system configured in accordance with the first configuration, the transport stations 1-5 (which hereon include 1') are driven for transporting the sheet at a constant speed which is the input speed. The nips of registration transport station 6 are operated in accordance with registration velocity profiles to slow down as they transport the sheet in order that the sheet is transported at the process speed upon arrival at the pre-transfer transport station 7, where the process speed is the speed at which the sheet is transported for pre-transfer processing and during the actual image transfer.

In a printing system configured in accordance with the second configuration, and in accordance with the present disclosure a motor assembly 202 is provided for driving transport stations 1-5, where motor assembly 202 includes at least one variable speed motor 204, e.g., a variable speed, pulse-width-modulated, servo motor, and may further include one or more constant speed motors 206, where each of the variable speed motors 204 and constant speed motors 206 are independently controllable. Motor assembly 202 drives the transport stations 1-5 to slow down the speed at which the sheet is transported from the speed at which the sheet is received (e.g., the input speed) to the process speed in order that the sheet is transported substantially at the process speed upon arrival at registration transport station 6.

Accordingly, the registration system 100 is modified for operating in the second configuration by providing one or more variable speed motors 204 for decreasing the transport speed of the sheet as it is transported through at least one of transport stations 1-5. Furthermore, modifications are made to the controller 50 for controlling the one or more variable speed motors 204 for driving the appropriate nips in accordance with velocity profiles for decreasing the transport speed of the sheet from the input speed to the process speed. Additionally, modifications are made for providing separate control to any constant speed motors 206 which are provided for driving any of transport stations 1-5.

In order to achieve a smooth transition of transport of the sheet from one transport station to a next downstream transport station, each of the motors of the motor assembly 202 may be controlled to drive a transport station receiving a sheet at the same speed at which the immediately upstream transport station was being driven as the sheet exited it, at least initially upon receipt of the sheet. Accordingly, transport station 1 and 1' may be driven at a speed for transporting the sheet at the input speed, at least initially.

A variety of configurations of the variable speed motors 204, the constant speed motors 206, control thereof, and correspondence between which transport stations 1-5 are controlled by the respective motors may be used. In one exemplary configuration (described with reference to the simplex mode) transport stations 1 and 2 are driven by one constant speed motor 206 for transporting the sheet at the input speed, and transport stations 3-5 are driven by one variable speed motor 204, where the speed of the variable speed motor 204 is gradually decreased for decreasing the transport speed of the sheet as it is transported from transport station 3 to transport station 5 to the process speed.

In another exemplary configuration (described with reference to the simplex mode), a constant speed motor 206 is provided for driving transport stations 1-4 for transporting the sheet at the input speed. A variable speed motor 204 is provided for driving transport station 5 for decreasing the transport speed of the sheet from the input speed to the process speed. In a further exemplary configuration (described with reference to the simplex mode) a variable speed motor 204 is provided for driving transport stations 1-3 for decreasing the transport speed of the sheet from the input speed to the process speed. A constant speed motor 206 is provided for driving transport stations 4 and 5 for transporting the sheet at the process speed.

In a further exemplary configuration (described with reference to the simplex mode), a constant speed motor is provided for driving transport stations 1-2 at the input speed. A first variable speed motor 204 is provided for driving transport stations 3-4, where the speed of the first variable speed motor 204 is gradually decreased for decreasing the transport speed of the sheet from the input speed to a reduced speed. A second variable speed motor 204 is provided for driving transport station 5, where the speed of the second variable speed motor 204 is decreased for further decreasing the transport speed of the sheet from the reduced speed to the process speed.

In still another exemplary configuration (described with reference to the simplex mode), a variable speed motor 204 is provided for driving transport station 1-5 for gradually decreasing the transport speed of the sheet from the input speed to the process speed as it is transported from station 1 to station 5. In some embodiments the sheet is initially transported at the input speed and somewhere during transport of the sheet from transport station 1 to transport station 5 the transport speed of the sheet is reduced to the process speed, and the sheet is provided to transport station 6 at the process speed. It is further contemplated that in other embodiments the transport speed of the sheet is reduced to a speed which is slower than the input speed and is provided to the registration transport station 6 at the reduced speed, and that the transport speed is further reduced by the registration transport station 6 to the process speed.

Driving of a respective transport station by the motor assembly 202 refers to driving the drive roller of at least the nips of the respective transport station 1, 2, 3, 4, and/or 5 which engage (or are expected to engage) the sheet for transport thereof. Accordingly, the two nips that engage the sheet during transport thereof are driven at the same speed as one another, in accordance with the same velocity profile, where applicable. In contrast, for the registration transport station 6 a first motor 208A drives the driver roller of nip 6A and second motor 208C drives the driver rollers of nips 6B and 6C so that the two nips grasping the sheet during transport thereof may be operated in accordance with different velocity profiles for applying different speeds to the sheet being registered, which exerts at least one force on the sheet, such as for adjusting skew and/or lateral position of the sheet. Another motor 210 is provided to drive transport station 7, where all of the nips of transport station which engage (or are expected to engage) the sheet for transport thereof are driven at the same speed by motor 210.

An encoder 212 is provided in association with each motor and/or the set of nips driven by the motor. The encoder 212 includes at least one sensor for sensing the speed at which the roller or shaft rotates and/or the speed at which the motor operates and generates a signal indicative of the speed at which the nip(s) are actually driven.

Additionally, a plurality of sensors 140 are provided for determining the location and speed of the sheet as it is transported. Sensors 101, 102, 103 and 178 may be edge sensors provided for sensing a lateral edge of the sheet, e.g., by sensing when the sensor is covered or uncovered by a lateral edge of the sheet and generating a corresponding signal, which may be time stamped. Sensors 111-119 and 179 are dash sensors for sensing an edge, e.g., a leading or trailing edge of the sheet, such as by sensing when the sensor is covered or uncovered by the sheet and generating a corresponding signal, which may be time stamped. Once the position of the leading edge of the sheet and the dimensions of the sheet are provided, the position of the trailing edge is computable, and vice versa. The dimensions of the sheet are provided to the controller 50 from a source not shown, such as additional sensors, the original source from which the sheet was stored and then dispensed, etc.

Sensor 120 is a point sensor for sensing a leading or trailing edge of the sheet, where the sensing by the point sensor 120 is cruder than the sensing by the dash sensors 111-119 and 179. Sensors 178 and 179 are learning sensors for sensing the position of the sheet during and/or after registration is performed. The output of sensors 101, 102, 103 and 111-120 are used for determining the velocity profiles for driving the respective transport stations by the variable speed motors 204, 208A, 208C and/or 210. The output of sensors 178 and 179 is used for fine tuning the registration of the sheet using pre-transfer transport station 7 and/or for adjusting velocity profiles associated with registration transport station 6 for registration of subsequent sheets. The fine tuning may be used to correct for timing, lateral positioning and skew errors which were not corrected by registration transport station 6 due to its constraints and/or differences in theoretical and actual corrections, errors due to wear of machine parts, such as rollers of the nips, etc.

The sensors may be photo detectors, charge coupled detectors (CCDs), etc. In an embodiment of the disclosure, dash sensors 119, 118, 117, 116, 115, 114, 113, 112, 111, and 179, respectively, are optoelectric reflective sensors with a gallium aluminum arsenide (Infrared) LED and phototransistor detector with adaptive interface having a trip point repeatability of +/−(25-50) microns. Edge sensors 102, 101 and 178 include a 2048 element CCD chip, having a responsiveness of 10 Hz, 6 v/(lux sec) peak at n=550 nm, and a dynamic range of 1600 (>1.2 Volt), and further include a Selfoc™ lens array from NSG America, Inc., 28 Worlds's Fair Drive, Somerset, N.J. 08873. The lens array includes 2 rows, a total conjugate of 32 mm, a wavelength of 570 nm, and a depth of focus of ±0.45 mm. Respective sensors 102, 101 and 178 also include four banks of six lamps, and generate a signal indicating a total number of illuminated pixels. Alternatively, in an alternate embodiment of the present disclosure, sensors 102, 101 and 178 generate a signal indicating a number of contiguous illuminated pixels, or unlit pixels, depending on a jumper-implemented selection. At least a portion of the sensors 140 may be mounted on a common bar.

An actuator assembly 220 including at least one actuator 222 is provided for engaging and disengaging the nips of transport stations 2-5. The actuators 222 may include a cam and stepper motor mechanism on their idlers for releasing the drive of their nips. Furthermore, another actuator 222 is provided for engaging and disengaging the nips of transport station 6, and another actuator 222 is provided for engaging and disengaging the nips of transport station 7. The actuators 222 are independently controllable for disengaging the nips of a respective transport station as soon as a subsequent transport station immediately downstream from the respective transport station engages the sheet, particularly when the subsequent transport station drives the sheet at a different speed or with a different velocity profile than the respective transport station. The immediacy of the release prevents the sheet from simultaneously being driven by transport stations at different speeds or by transport stations having different velocity profiles, which could otherwise cause damage to the sheet. Accordingly, adjustments by the registration transport station 6 are not begun until the transport station 5 has disengaged.

It follows that the registration system 100 is modified for operating in the second configuration by strategically providing the at least one independently controllable actuators 222 of the actuator assembly 220 for independently engaging and disengaging selected transport stations of transport stations 1-5. The transport stations are selected in accordance with the configuration of the variable speed motors 204 and the constant speed motors 206, including the configuration of which transport stations are driven by the respective variable speed motors 204. Particularly, a selected transport station is a transport station driven by one of a constant speed motor 206 or a variable speed motor 204 which is adjacent to a transport station driven by the other of the constant speed motor 206 or variable speed motor 204. Furthermore, modifications are made to the controller 50 for controlling the at least one actuator 222 of the actuator assembly 220.

Figure 3:
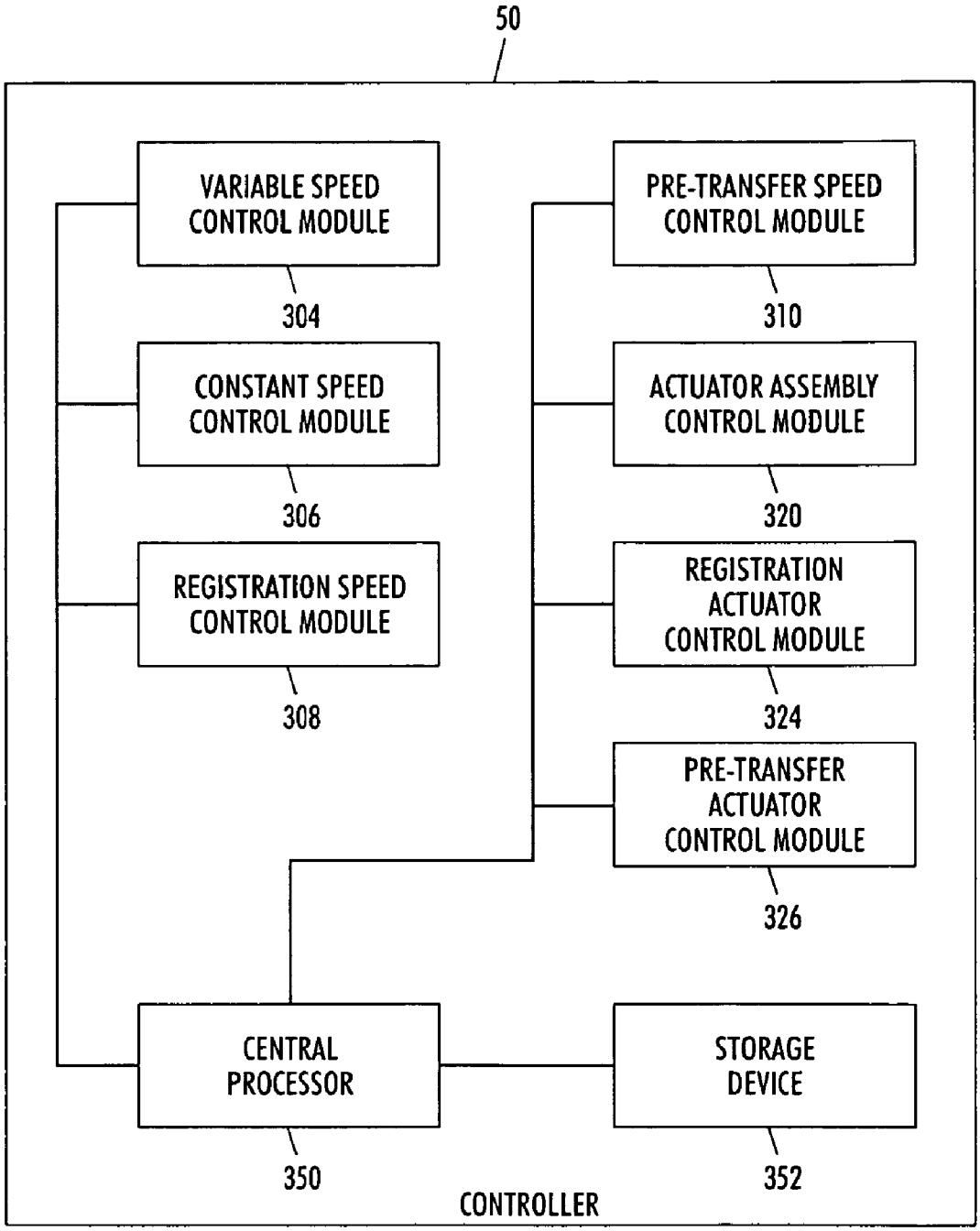
FIG. 3 is a block diagram of a controller of the printing system shown in FIG. 1.

FIG. 3 shows modules of the controller 50, including a respective variable speed control module 304 for independently controlling the speed of respective variable speed motors 204, a respective constant speed control module 306 for independently controlling the speed of respective constant speed motors 206, a registration speed control module 308 for controlling the respective speeds of the variable speed motors 208A and 208C, and a pre-transfer speed control module 310 for controlling the speed of the variable speed motor 210. The controller 50 further includes an actuator assembly control module 320, including an actuator sub-module for independently controlling respective actuators 222 of the actuator assembly 220. Additionally the controller includes a registration actuator control module 324 for controlling the actuator 222 which is associated with registration transport station 6, and a pre-transfer actuator control module 326 for controlling the actuator 222 which is associated with the pre-transfer transport station 7. It is contemplated that one or more of the above control modules may be combined and/or include sub-modules.

One or more of the control modules may be provided on respective circuit boards, the respective circuit boards including at least one processor, at least one storage device for storing programmable instructions and/or data executable by the at least one processor, at least one analog device, at least one logic device (e.g., a reconfigurable logic array, configurable with the programmable data) or a combination thereof. One or more of the circuit boards may be provided on a backplane of the printer system 1000. The respective control modules 304, 306, 308, 310, 320, 324 and 326 generate control signals for providing control as described above, where the control signals may be signals such as pulse width signals. The respective motor or actuator being controlled is responsive to the received control signals (e.g., pulse width signals) for operating in accordance with the control signals.

Furthermore, the controller 50 may include a central processor 350 for controlling at least a portion of the control modules. At least one storage device 352 may be provided which is accessible to the central processor 350. The at least one storage device 352 may include nonvolatile memory, such as flash memory, for storing data, including target values (expected arrival times at a particular sensor, expected speed at particular stages of the registration process, etc.), roller to sheet speed ratios, etc., associated with a variety of sheet types, including target values, such as for arrival time or speed at a particular stage of the registration, including for first and second sides of each sheet type. Data stored by the storage device 352 may be exchanged with a respective control module upon power-up, particularly with the registration speed and actuation control modules 308, 326, respectively, and may be stored by the storage devices associated with the respective control modules. Furthermore, data may be sent from one or more of the control modules to the central processor 350 to update the data stored by the storage device 352.

The controller 50 receives inputs including the output from sensors 140, sheet profile data (including, for example, the sheet size, sheet type, if the sheet is duplex or simplex, which side (first or second side for duplex sheets) of the sheet is being processed for receiving the image), output from the encoders 212, the speed of belt 10 and the time at which laser 29 scanned the image. Using time stamped information provided by the sensors 140 relating to the sheet position in two dimensions, together with the information relating to the speed of the belt 10 and the time at which the image was scanned, the controller 50 generates velocity profiles and control signals for controlling the motors and actuators for transporting the sheet to the registration transport station 6 at a target time, registering the sheet at the registration transport station 6, fine tuning registration of the sheet at pre-transfer transport station 7, all performed in real time and in synchronism with the position and speed of the image on the belt 10 for bringing the sheet into contact with an image moving on the belt 10.

Signals received by a respective encoder 212, such as the number of pulses of the signals received from the encoders 212, are tracked, such as for comparing an actual velocity of the roller of an associated nip to a target velocity for the roller. The results of the comparison (e.g., a ratio or a difference) are used by the control modules 304, 306 and/or 308 to adjust pulse width modulation.

The velocity profile for the respective nips driven by the variable speed motors 204 may be in accordance with a constant deceleration for decelerating the variable speed motor(s) 204 at a constant rate. The deceleration rate may or may not be adjustable with respect to other variables, such as sensed and/or target values. For example, the variable speed control module 304 may calculate the velocity profile for the respective nips driven by the variable speed motors 204 in accordance with at least the sensed and calculated position of the sheet; speed and orientation of the sheet as it is transported through the registration system 100; the desired position, speed, and orientation of the sheet upon predicted arrival at the registration transport station 6; and the time at which the sheet is predicted to arrive at registration transport station 6. The velocity profiles determined by the variable speed control module 304 define deceleration of transport of the sheet for delivering the sheet to the registration transport station 6 at the process speed.

The registration speed control module 308 calculates the velocity profile for the rollers of both nip 6A and nip 6B in accordance with at least the sensed and calculated position of the sheet, sensed speed and orientation of the sheet when it enters nips 6A and 6B, the desired position, speed and orientation of the sheet upon predicted arrival at the pre-transfer transport station 7, and the predicted amount of available time for performing registration correction. The predicted amount of available time is, for example, the time difference between sensed arrival at registration transport station 6 and expected arrival at the pre-transfer transport station 7.

Additionally, the variable speed control module 304 and/or the registration speed control module 308 may calculate an acceleration/deceleration profile (triangular velocity profile) for accelerating and decelerating a respective nip driven by a motor being controlled to the desired speed at which the next sheet should be received, and which may include rephasing the nip driven. The respective nip is driven by the constant acceleration/deceleration profile as soon as the nip releases the sheet and the trail edge of the sheet has been transported past the nip, e.g., during an inter-sheet gap. The rephasing profile is designed to adjust the nip's roller's angular position such that the leading edge of the subsequent sheet always meets the roller close to a target angular roller position for preventing excessive nip wear caused by the edge of the sheets always contacting the same spot on the roller. The nip is accelerated and decelerated to the speed at which it expects to receive the subsequent sheet.

The velocity profiles for the nips 6A and 6B are calculated to correct skew and lateral position errors by varying the speed of nips 6A and 6B relative to each other. When the different speeds are applied an inboard (IB) or outboard (OB) sheet movement to the sheet is caused for a period of time for either skewing, deskewing or straightening the sheet out for achieving the desired IB to OB offset. Furthermore the velocity profiles for the nips 6A and 6B are calculated to correct for timing errors in the process direction, by adjusting the average speed of the nips 6A and 6B.

Tables 1-4 below show results of simulation tests performed for comparing a printer system configured in the first configuration to a printer system configured in the second configuration.

TABLE 1

| Analysis Results of Current Agile System (100 PPM) | | | |
|---|---|---|---|
| Registration Time, sec | 0.140 | 0.170 | 0.200 |
| Minimum Speed during Registration, m/sec | 0.310 | 0.198 | 0.091 |
| Maximum Speed during Registration, m/sec | 1.769 | 1.482 | 1.308 |
| Maximum Required Tangential force during Registration, N | 4.08 | 2.94 | 2.33 |
| Minimum Gap to Downstream Sheet, m | 0.027 | 0.018 | 0.007 |

Input Speed: 1.025 m/sec
Process Speed: 0.468 m/sec
Input Lateral Error: −0.011~0.011 m
Input Skew: −0.02~0.02 rad Table 1 shows results of a first simulation test performed for operating a printing system configured in the first configuration operating at a speed of 100 PPM. The sheet arrives at registration transport station 6 at an input speed of 1.025 m/sec and is slowed down to a process speed of 0.468 m/sec upon arrival at the pre-transfer transport station 7. The nominal registration time, which is the time from which the sheet's leading edge arrives at the registration transport station 6 until the leading edge arrives at the pre-transfer transport station 7, is 0.170 sec. The nominal registration time is set to 0.170 sec to maximize the range of registration errors acceptable to the system. Allowing for a timing error of 0.03 sec, tests were performed for testing the range of registration times (0.170 sec.±0.03 sec). Accordingly, each of registration times 0.140 sec, 0.170 sec, 0.200 sec was tested over a range of lateral errors (−0.011~0.011 m) and a range of skew errors (−0.02~0.02 rad). The results tabulated in Table I show outside results obtained over the range of lateral errors and range of skew errors for each of the registration times tested.

As shown in Table 1, as the registration time increases the minimum speed during the registration drops. The low speed during the registration may contribute to a degradation of accuracy in motion control, such as due to increased disturbances to rotational kinematic energy of a rotor of one or more of the motors driving one or more of the transport stations transporting the copy sheet, such as the registration transport station 6. As the registration time decreases, the maximum required tangential force increases, which then may cause a problem of marking of the sheet (particularly for coated paper) due to the increase of normal force at the nips of the registration transport station 6. Accordingly, the minimum registration speed 0.091 m/sec and the maximum tangential force 4.08 N measured in the testing which is tabulated in Table 1 are considered as limiting values, and may be used as constraints for configuration of other printing systems.

TABLE 2

| Analysis Results of Current Agile System (135 PPM) | |
|---|---|
| Registration Time, sec | 0.153 |
| Minimum Speed during Registration, m/sec | 0.081 |
| Maximum Speed during Registration, m/sec | 1.729 |
| Maximum Required Tangential force during Registration, N | 4.10 |
| Minimum Gap to Downstream Sheet, m | 0.028 |

Input Speed: 1.3838 m/sec
Process Speed: 0.6318 m/sec
Input Lateral Error: −0.011~0.011 m
Input Skew: −0.02~0.02 rad Table 2 shows the results for a simulation test performed with a printing system configured in the first configuration and operated at a speed of 135 PPM. The input speed and the process speed were prorated according to the speed of 135 PPM. The results tabulated in Table 2 for minimum registration speed and maximum tangential force exceed the constraints established by the limiting values determined by the testing tabulated in Table 1. Furthermore, application of the constraints established in Table 1 provides no latitude for the timing error in the process direction. Accordingly, further testing was not performed over the range of timing errors. ±0.03 sec. A reduced registration time would cause the tangential force to further increase beyond the limiting value, and an increased registration time would cause the minimum registration speed to further decreases below the limiting value.

TABLE 3

| Analysis Results of Proposed Agile System (135 PPM) | | | |
|---|---|---|---|
| Registration Time, sec | 0.142 | 0.172 | 0.202 |
| Minimum Speed during Registration, m/sec | 0.531 | 0.436 | 0.340 |
| Maximum Speed during Registration, m/sec | 1.634 | 1.313 | 1.102 |
| Maximum Required Tangential force during Registration, N | 4.07 | 2.78 | 2.04 |
| Minimum Gap to Downstream Sheet, m | 0.030 | 0.022 | 0.013 |

Input Speed: 1.3838 m/sec
Process Speed: 0.6318 m/sec
Input Lateral Error: −0.011~0.011 m
Input Skew: −0.02~0.02 rad Table 3 shows results of simulated testing performed for a printing system configured in accordance with the second configuration in which the sheet transport speed is reduced to the process speed before the lead edge of the sheet arrives at registration transport station 6. The sheet is then registered by registration transport station 6 and delivered to pre-transfer transport station 7 as before. The printing system is operated at a speed of 135 PPM. Allowing for a timing error of ±0.03sec, tests were performed for testing the range of registration times (0.172sec.±0.03 sec). The nominal registration time is set to 0.172 sec to maximize the range of registration error acceptable to the system. Accordingly, each of registration times 0.142 sec, 0.172 sec, 0.202 sec was tested over a range of lateral errors (−0.011~0.011 m) and a range of skew errors (−0.02~0.02 rad). The results tabulated in Table 3 show outside results obtained over the range of lateral errors and range of skew errors for each of the registration times tested, all of which did not exceed the limit values.

TABLE 4

| Analysis Results of Proposed Agile System (150 PPM) | | | |
|---|---|---|---|
| Registration Time, sec | 0.142 | 0.172 | 0.202 |
| Minimum Speed during Registration, m/sec | 0.534 | 0.415 | 0.301 |
| Maximum Speed during Registration, m/sec | 1.608 | 1.298 | 1.099 |
| Maximum Required Tangential force during Registration, N | 4.07 | 2.80 | 2.16 |
| Minimum Gap to Downstream Sheet, m | 0.026 | 0.016 | 0.004 |

Input Speed: 1.5375 m/sec
Process Speed: 0.702 m/sec
Input Lateral Error: −0.011~0.011 m
Input Skew: −0.02~0.02 rad Table 4 shows results of simulated testing performed for a printing system configured in accordance with the second configuration operating at a speed of 150 PPM. Allowing for a timing error of ±0.03 sec, tests were performed for testing the range of registration times (0.172 sec.±0.03 sec). The nominal registration time is set to 0.172 sec to maximize the range of registration errors acceptable to the system Accordingly, each of registration times 0.142 sec, 0.172 sec, 0.202 sec was tested over a range of lateral errors (−0.011~0.011 m) and a range of skew errors (−0.02~0.02 rad). The results tabulated in Table 4 show outside results obtained over the range of lateral errors and range of skew errors for each of the registration times tested, all of which did not exceed the limit values.

The results tabulated in Table 3 and Table 4 show that a printing system configured in accordance with the second configuration accommodates up to ±0.03 sec of timing error in the process direction. The minimum registration speed results tabulated in Tables 3 and 4 are substantially greater than the limiting minimum value established. Accordingly, the constraint of minimum speed is virtually eliminated for printing systems configured in accordance with the second configuration. A further benefit obtained by the increased registration time due to sheet slowdown before registration is that the timing latitude allowed for transport station 5 to open or disengage the sheet before the registration adjustments performed by transport station 6 starts is increased. Furthermore, the timing latitude for adjusting the timing, lateral position and skew errors once transport station 5 has disengaged is increased.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An electrographic printing system comprising:

a movable image carrying member for carrying a developed liquid toner image;

a transfer station for transferring the developed liquid toner image to a sheet at a process speed;

a registration system for registering the sheet transported along a sheet path, the registration system comprising:

a non-registering first transport station configured to slow the sheet based on a first set of predetermined registration velocity profiles for applying a first set of speeds before commencement of registration, the non-registering first transport station is disposed along the sheet path for receiving the sheet substantially at an input speed and for slowing the sheet along the sheet path to a registering speed which is slower than the input speed;

a first apparatus in operative communication with the non-registering first transport station for decreasing the speed of the sheet to the registering speed;

a registering second transport station configured for registering the sheet based on a second set of predetermined registration velocity profiles for applying a second set of speeds after the commencement of registration, the registering second transport station is disposed downstream the sheet path relative to the non-registering first transport station and upstream of the transfer station for receiving the sheet at a process speed; and a second apparatus in operative communication with the second transport station for exerting at least one force on the sheet for registering the sheet by correcting at least one of lateral position of the sheet, skew of the sheet, and timing error in the downstream direction, wherein the registering speed is approximately equal to the process speed when the leading edge of the sheet arrives at the registering second transport station; and wherein the first set of predetermined registration velocity profiles are different than the second set of predetermined registration velocity profiles and the first set of speeds are different than the second set of speeds.

2. The printer system according to claim 1, wherein the second apparatus comprises at least one variable speed motor for driving the second transport station at a speed tat is selectable.

3. The printing system according to claim 1, wherein the non-registering first transport station at least partially transports the sheet at a constant speed.

4. The printing system according to claim 3, wherein the non-registering first transport station comprises at least one constant speed motor for at least partially transporting the sheet at the constant speed.

5. The electrographic printing system according to claim 1, wherein the at least one force is less than 4.08 Newtons, the process speed is about 0.6318 meters per second and the input speed is about 1.3838 meters per second.

6. The electrographic printing system according to claim 1, wherein the sheet is in the registering second transport station from about 0.142 second to about 0.202 seconds, the process speed is about 0.6318 meters per second and the input speed is about 1.3838 meters per second.

7. The electrographic printing system according to claim 1, wherein the registration speed has a minimum speed from about 0.340 meters per second to about 0.531 meters per second while the sheet is in the registering second transport station, the process speed is about 0.6318 meters per second and the input speed is about 1.3838 meters per second.

8. The electrographic printing system according to claim 1, wherein the registration speed has a maximum speed from about 1.102 meters per second to about 1.634 meters per second while the sheet is in the registering second transport station, the process speed is about 0.6318 meters per second and the input speed is about 1.3838 meters per second.

9. The electrographic printing system according to claim 1, wherein the registration speed has a minimum speed from about 0.301 meters per second to about 0.534 meters per second while the sheet is in the registering second transport station, the process speed is about 0.702 meters per second and the input speed is about 1.5375 meters per second.

10. The electrographic printing system according to claim 9, wherein the registration speed has a maximum speed from about 1.099 meters per second to about 1.608 meters per second while the sheet is in the registering second transport station.

11. A method for registering a sheet transported along a sheet path of a printing system comprising:

receiving a sheet at a non-registering first location of a registration system at an input speed;

transporting the sheet along the sheet path from the non-registering first location in a downstream direction at the input speed while not registering the sheet;

decreasing the speed at which the sheet is transported from the input speed to a registering speed based on a first set of predetermined registration; velocity profiles for applying a first set of speeds before commencement of registration;

receiving the sheet while being transported at the registering speed at a registering second location of a registration system downstream from the non-registering first location, wherein the registering speed is approximately equal to a process speed when the leading edge of the sheet arrives at the registering second location;

registering the sheet at the registering second location based on a second set of predetermined registration velocity profiles for applying a second set of speeds after the commencement of registration;

receiving the registered sheet at a processing location at the process speed; and transferring a developed liquid toner image to the sheet at the process speed;

wherein the first set of predetermined registration velocity profiles are different than the second set of predetermined registration velocity profiles and the first set of speeds are different than the second set of speeds.

12. The method according to claim 11, further comprising:

sensing at least one entity related to at least one of progress of the sheet as it is transported along the sheet path and the transporting of the sheet;

generating signals corresponding to the sensing; and adjusting the decreasing as the sheet is transported along the sheet path in accordance wit the signals corresponding to the sensing.

13. The method according to claim 11, further comprising the step of transporting the sheet at a constant speed which ranges between the input speed and the registering speed before registering the sheet.

14. The method according to claim 13, wherein the step of transporting the sheet further comprises:

grasping the sheet while decreasing the speed at which the sheet is transported;

gasping the sheet while transporting the sheet at the constant speed; and releasing the sheet in between decreasing the speed of the sheet and transporting the sheet at the constant speed.

15. A registration system for registering a sheet transported along a sheet path of a printing system, the registration system comprising:

a non-registering first transport station disposed along the sheet path for receiving the sheet at a input speed and for transporting the sheet along the sheet path at a registering speed which is slower than the input speed based on a first set of predetermined registration velocity profiles for applying a first set of speeds before commencement of registration;

a first apparatus in operative communication with the non-registering first transport station for decreasing the input speed of the sheet to the registering speed;

a registering second transport station disposed downstream of the non-registering first transport station for receiving the sheet at the registering speed based on a second set of predetermined registration velocity profiles for applying a second set of speeds after the commencement of registration, wherein the registering speed is approximately equal to a process speed when the leading edge of the sheet arrives the registering second transport station, wherein the registering second transport station is configured to transfer the sheet after registration to a transfer station for transferring the developed liquid toner image to the sheet at the process speed; and a second apparatus in operative communication with the registering second transport station for exerting at least one force on the sheet for registering the sheet by correcting at least one of lateral position of the sheet, skew of the sheet, and timing error in the downstream direction;

wherein the first set of predetermined registration velocity profiles are different than the second set of predetermined registration velocity profiles and the first set of speeds are different than the second set of speeds.

16. The registration system according to claim 15, wherein the first apparatus comprises a variable speed motor for varying the speed at which the sheet is transported.

17. The registration system according to claim 16, the first apparatus further comprising a controller having at least one processor for controlling the variable speed motor to drive the first transport station for decreasing the speed at which the sheet is transported.

18. The registration system according to claim 16, wherein the registration system further comprises at least one additional transport station upstream from the registering second transport station for transporting the sheet at a constant speed, the registration system further comprising:

at least one constant speed motor for driving the at least one additional transport station at the constant speed; and a controller having at least one processor for controlling the variable speed motor to drive the non-registering first transport station for decreasing the speed at which the sheet is transported, and for controlling the constant speed motor, wherein the variable speed motor and the constant speed motor are independently controlled.

19. The registration system according to claim 15, wherein the registration system further comprises at least one additional transport station upstream from the registering second transport station for transporting the sheet at a constant speed.

20. The registration system according to claim 19, wherein the registration system further comprises at least one constant speed motor for driving the at least one additional transport station at the constant speed.

* * * * *